US006092889A

United States Patent [19]

Nakamoto et al.

[11] Patent Number: 6,092,889

[45] **Date of Patent: *Jul. 25, 2000**

[54] INK-JET HEAD AND INK-JET RECORDING DEVICE EACH HAVING A PROTRUDED-TYPE ELECTRODE

[75] Inventors: Masayuki Nakamoto, Chigasaki; Shuzo Hirahara, Yokohama; Teruo Murakami, Yokohama; Hitoshi Nagato, Tokyo; Hideyuki Nakao, Kawasaki, all of Japan

[73] Assignee: Kabushiki Kaisha Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/712,668

[22] Filed: Sep. 13, 1996

[30] Foreign Application Priority Data

Sep. 13, 1995 [JP] Japan ..... 7-235413
Sep. 13, 1995 [JP] Japan ..... 7-235414

[51] Int. Cl.[7] ..... B41J 2/06
[52] U.S. Cl. ..... 347/55
[58] Field of Search ..... 347/55, 112, 141, 347/151

[56] References Cited

U.S. PATENT DOCUMENTS 3,886,565 5/1975 Kojima ..... 347/55
4,117,778 10/1978 Watanabe et al. ..... 347/55
4,314,263 2/1982 Carley ..... 347/55
4,768,044 8/1988 Shimosato et al. ..... 347/55
5,144,340 9/1992 Hotomi et al. ..... 347/55
5,400,061 3/1995 Horio et al. ..... 347/55

FOREIGN PATENT DOCUMENTS 703 081 3/1996 European Pat. Off. ..... B41J 2/06

*Primary Examiner*—John Barlow
*Assistant Examiner*—C. Dickens
*Attorney, Agent, or Firm*—Oblon, Spivak, McClelland, Maier & Neustadt, P.C.

[57] ABSTRACT

An ink-jet head and its manufacturing method and an ink-jet recording device, which condense a color component in an ink with the color dissipated in a solvent, and record with the ink flown toward a record medium. A protruded-type electrode and its leading electrode are formed on a supporting substrate. An ink-guide-groove which is formed from the bottom section to the pointed end portion on the wall surface, is provided at the protruded-type electrode. A connected portion by the protruded-type electrode of the leading electrode and an end portion of an opposite portion are exposed outward. A plurality of protruded-type electrodes are provided on the supporting substrate along main scanning direction X. The shape of the protruded-type electrode is pyramid, and its pointed end portion is sharpened. Ink guide grooves are formed on each wall surface of the pyramid of the protruded-type electrode. A width of the ink guide groove becomes narrower as the distance to the pointed end portion decrease from the bottom portion.

38 Claims, 6 Drawing Sheets

INK-JET HEAD AND INK-JET RECORDING DEVICE EACH HAVING A PROTRUDED-TYPE ELECTRODE

BACKGROUND OF THE INVENTION

1. Field of the Invention

This invention relates to an ink-jet head and its manufacturing method and an ink jet recording device for recording to a record medium to jet a condensed color component in an ink with the color dissipated in a solvent.

2. Description of the Related Art

In recent years, exploitation of an ink-jet printer is implemented actively as one of the information output apparatus, along with improvement of the computer technology and with advance of an information-oriented society. The ink-jet printer records graphs, images and so forth to a record medium such as a recording paper or the like in such a way that a liquid ink is jetted in atmosphere in the semblance of small drops, fine liquid column, or mist. The ink-jet printer generates few noises, since it records with the ink-drops jetted, under the condition of fundamentally non-contact and non-impact record. Further a relatively easy high quality color record by the ink-jet printer can be implemented because it is possible to record to a normal paper without implementation of a complicated processing such as development and fixing and so forth in an electro-photographic printer, and it is possible to superimpose ink-drops of color ink due to a direct record by using the ink.

There are various methods of the ink-jet printer, for example, a bubble jet method in which the bubble is generated instantaneously by the exothermic resistance element, before jetting an ink by pressure of the bubble (K. Hara et. al., Image-Electronics Society Journal, vol.11, 2(1982)), and a method in which the ink is jetted by the pressure pulse generated by using the piezoelectric element or the electrostrictive element with an electrical signal converted to mechanical vibration (E. Stemme et. al., IEEE Trans. ED20-1, p14(1973)). These are representative.

In these ink-jet printers, in all cases an ink nozzle is used. However if the size of the ink nozzle is reduced to enhance the resolution by increasing the number of nozzle, a clogging of the ink nozzle generates easily caused by vaporization of the solvent, which becomes a great cause of lowering of reliability. In the bubble jet method, the bubble due to the vapor in high temperature instantaneously generated is used as the pressure source, there is a problem that solids due to the thermal or chemical reaction in high temperature between the nozzle and the ink, adhere to the wall of the nozzle. In the methods using the piezoelectric element or electrostrictive element, a clogging is generated easily due to the complicated mechanism such as a route of the ink.

In recent years, a printer with higher resolution is required. In the conventional bubble jet method, it is difficult to form an ink-drop whose particle diameter is less than 20 $\mu$m. Only minimum dot diameter of about 50 $\mu$m is obtained on the record medium. The pressure method by the electrostrictive element becomes very complicated structure, with the result that it is difficult to produce it due to the problem for the processing technology.

As the method to resolve these problems, as shown in FIG. 1, there is a method in which a high voltage is applied between a thin film type electrode and an opposite electrode existing at rear face of a recording paper, drawing an ink-drop from a small slit due to an electrostatic attraction force. As shown in FIG. 2, there is a method in which it is used an ink including a charged color component, the condensed ink is jetted. The former has a slit type nozzle which is not required a nozzle every dot. In the latter, a problem of clogging can be reduced because of a nozzle less method and also a ink-drop can be jetted with fine particle diameter stably generated. An implementation of high resolution is possible.

However, as shown in FIGS. 1 and 2, the head of the ink-jet printer in these electrostatic method in which the pointed end of the electrode array 42, 52 project out of the end face of the head substrates 41, 51, or meet the end face thereof. Accordingly, the electrode array would be easy to damage because the recording paper comes into contact with the electrode array. Further, from the view point of the manufacturing method thereof, it can not use a high precision manufacturing technology used in semiconductor manufacturing process such as the stepper exposure technology, thereby there are problems of processing precision, uniformity, and yield and so forth. Particularly, it can not prepare radius of curvature for the pointed end of the head with moderately small and uniformly, consequently it is necessary to apply high voltage to the pointed end of the head, with the result that it would be disturbed an implementation for low voltage drive, and there is a problem of an extra ordinary discharge caused by the shape non-uniformity.

When it intends to constitute a multi-head such as a line-head with a plurality of heads, as shown in FIGS. 1 and 2, since the electrode array portion is formed on the surface of the head substrate, the electric field influences between adjacent electrodes with each other with the result that concentration and the jet of the ink-drops from the individual electrode become unstable. As the extensive case, there is a serious problem that the ink-drops repelled by the adjacent electrodes jet between the electrodes.

Further, it is necessary to be formed stably an ink layer at the pointed end of the head by capillary phenomenon in order to jet with the ink condensed and concentrated at the pointed end of the head. However, it is difficult to form stably an ink layer for the reason why the effect of gravity is not equivalent at the pointed end of the head which is formed at the above described end face of the head substrate.

As described above, since the ink-jet printer head in which the color component within the liquid ink is jetted by the conventional electrostatic force, includes the electrode array located at the end face of the head substrate, the recording paper or the like which comes into contact with the electrode array in the printer assembly, which is easy to damage. Further, in regard to the manufacturing of the head, there are problems of the processing precision, the uniformity, and the yield because it can not use the high precision manufacturing technology which is implemented in the semiconductor manufacturing process. Particularly, since it can not be made radius of curvature for the pointed end of the head with moderately small and uniformly, applying high voltage to the pointed end of the head is required, with the result that it would be disturbed an implementation for low voltage drive, and there is a problem of an extra ordinary discharge caused by the shape non-uniformity. When it intends to constitute a multi-head, since the electrode array portion is formed on the surface of the head substrate, the electric field influences between adjacent electrodes with each other with the result that concentration and the jet of the ink-drops from the individual electrode become unstable. As the extensive case, there is a serious problem that the ink-drops repelled by the adjacent electrodes jet between the electrodes. Further, it is necessary to be formed stably an ink layer at the pointed end of the head by capillary phenomenon in order to jet with the ink condensed and concentrated at the pointed end of the head. However, there is a problem that it is difficult to form stably an ink layer for the reason why the effect of gravity is not equivalent at the pointed end of the head which is formed at the end face of the head substrate.

SUMMARY OF THE INVENTION

In view of the foregoing, it is an object of the present invention for resolving the above-mentioned problems to provide an ink-jet head and its manufacturing method as well as an ink-jet recording device in which a damage of a head can be prevented when a color component within an ink is jetted toward a record medium with the color component of the ink concentrated by using an electrostatic force, it can be provided a plurality of same shape heads with good uniformity and few dispersion, there is no bad influence with regard to an ink condensation, concentration and flight to the object due to mutual influence of electric field between adjacent electrodes, high quality of record can be implemented with the stable ink layer at the pointed end of the head formed, it is easy to implement a high accumulation thereof, and it is rich in productivity.

According to the first aspect of the present invention, for achieving the above-mentioned object, there is provided an ink-jet head used to an ink-jet recording device which records on a record medium in such a way that color components within an ink including a color component dissipated in a solvent are concentrated and the concentrated color component is jetted, the ink-jet head comprises a substrate having a main surface, the main surface being provided oppositely to the record medium, a protruded-type electrode provided on the substrate, an ink supplying means for supplying the ink to at least a vicinity of the protruded-type electrode of the substrate. Here, it is preferable that the substrate has at least one concave portion within which the protruded-type electrode is provided, and the ink supplying means supplies the ink into the concave portion.

In above configuration, the protruded-type electrode may include one of electrodes having various shapes which include a pyramid, e.g., a triangular pyramid, a rectangular pyramid, a polygonal pyramid or the like, and a circular cone, a circular cylinder, a hemisphere, and a Mexican pyramid.

It might be provided a plurality of protruded-type electrodes in one ink holder. Further, on the head substrate, it might be provided a plurality of ink holders within which singular or the plurality of protruded-type electrodes might be provided respectively.

According to the second aspect of the present invention, there is provided an ink-jet head wherein the protruded-type electrode comprises a bottom portion contacting with the substrate, a pointed end portion, and a groove formed from the bottom portion toward the pointed end portion. The protruded-type electrode further includes a concave portion formed at the pointed end portion.

It is not necessary that the pointed end is sharpened. In the present invention, it might be adopted a pyramid, a cone, a spindle, or a Mexican pyramid constituted by cutting off the pointed end of the pyramid as the shape of the protruded-type electrode. It might be good that the pointed end of the protruded-type electrode become stable wet state by the ink due to the capillary phenomenon and the voltage application to the protruded-type electrode, and also it might be good that the shape of the protruded-type electrode is the shape to which the electric field for concentrating the ink and jetting the ink is applied sufficiently. When the groove is formed on the protruded-type electrode, a cross sectional shape of the groove can be selected from the various kinds of the shapes such as a hemisphere-shape, a trapezoid-shape, and V-shape. It might be selected a shape in which the ink is applied sufficiently to the pointed end of the protruded-type electrode due to the capillary phenomenon. It is preferable that the average width of the groove is more than 0.1 $\mu$m.

The bottom portion of the protruded-type electrode might be 0.5 to 200 $\mu$m, and 5 to 80 $\mu$m is more preferable. A small radius of curvature of the pointed end portion is preferable. 0.5 to 100 $\mu$m is preferable, and 5 to 20 $\mu$m is more preferable. On the other hand, the layer in which the string shaped projection is constituted, is preferably made of resist, glass, or a head electric conductive material, as well as metal in which selective etching is capable. Further, when the silicon single crystal substrate is employed for the first substrate in regard to the etching stopping layer, it might be formed a surface including its inside of the concave portion by the thermal oxidization, or it might be formed another method. It is preferable that the simplification of the process can be planned since the thermal oxidization method is superior in the process matching property in respect of the general semiconductor manufacturing process.

As described above, in the present invention, the ink-jet head is constituted with the protruded-type electrode on the head substrate formed, the ink including the color dissipated into the solvent is supplied at least the in vicinity of the protruded-type electrode on the head substrate. Since the record is so implemented that at least the color component within the ink is jetted from the head substrate, namely main face of the substrate toward the record medium. It is prevented the damages at the pointed end of the head in the head assembly such as the conventional ink-jet head with the head formed on the end face of the head substrate. When it is formed a hollow shaped ink holder from the surface of the head substrate, also, it is prevented the damages at the pointed end of the head in the head assembly such as the conventional ink-jet head with the head formed on the end face of the head substrate.

Since the protruded-type electrode being the pointed end of the head is provided at the main surface of the head substrate, it is easy to produce a multi-head such as a line-head in which a plurality of the same shaped protruded-type electrodes with good uniformity and few dispersion are formed due to the manufacturing method utilizing the semiconductor processing process with high precision which could not be utilized in the conventional technology where the pointed end of the head is provided at the end face of the head substrate. Particularly, according to the manufacturing method of the ink-jet head of the present invention, it can be prepared radius of curvature for the pointed end of the head with moderately small and uniformly, consequently it is not necessary to apply high voltage to the pointed end of the head, with the result that it would be achieved an implementation for low voltage drive, and it can be prevented an extra ordinary discharge caused by the shape non-uniformity.

When the ink holder is provided, if the ink is supplied sufficiently to the pointed end of the protruded-type electrode, as well as it can be prevented the electric field effect between adjacent electrodes, various shapes of the ink holder such as a parallel rectangular shape, a trapezoid shape, and a hemisphere shape can be implemented. Here, since the protruded-type electrode is provided within the ink holder which is hollow beneath the surface of the head substrate, when the multi-head is constituted, there becomes no electric field influence between the adjacent electrodes, thereby the jet and concentration of the ink-drops from the individual protruded-type electrode can be stabilized, with the result that it can be avoided the serious problem that the ink-drops repelled between the electrodes jet between the electrodes.

According to the third aspect of the present invention, there is provided an ink-jet recording device which utilizes the above described ink head, and which records on a record medium in such a way that color components within an ink including a color component dissipated in a solvent are concentrated and the concentrated color component is jetted, the ink-jet recording device comprises an ink-jet head described above, and a voltage applying means for applying a voltage to a protruded-type electrode in which the voltage corresponds to a image signal to jet at least a color component in an ink supplied on a substrate by an ink supplying means from the protruded-type electrode toward the record medium. There is provided an ink-jet recording device which records on a record medium in such a way that color components within an ink including a color component dissipated in a solvent are concentrated and the concentrated color component is jetted, the ink-jet recording device comprises an ink-jet head described above, and a voltage applying means for applying a voltage to a protruded-type electrode in which the voltage corresponds to a image signal which has the same polarity as a charged polarity of the color, to jet at least a color component in an ink supplied on a substrate by an ink supplying means from the protruded-type electrode toward the record medium.

It is necessary to be stably formed an ink layer at the pointed end portion of the protruded-type electrode being the head tip by the capillary phenomenon in order to jet with the ink-drop concentrated. In the present invention, a groove can be formed on wall surface of the protruded-type electrode from the bottom portion to the pointed end portion, and the protruded-type electrode being the pointed end of the head can be provided at the neighborhood of surface of the ink within the ink holder whereby it becomes possible to form stably the ink layer at the pointed end of the protruded-type electrode, and it can be realized an ink-jet recording device with high performance and high resolution.

According to the fourth aspect of the present invention, there is provided a manufacturing method of an ink-jet head which comprises the steps of providing a concave portion on a first main surface of a first substrate, forming an etching stopping layer on the first main surface including the concave portion, forming at least one string shaped projection along a direction of a depth of the concave portion on the etching stopping layer on the inside of the concave portion, forming a electrode layer on the etching stopping layer so as to bury an inside of the concave portion of the etching stopping layer, providing a second substrate on the electrode layer, removing the first substrate, and forming a protruded-type electrode having a groove corresponding to the projection by exposing the electrode layer with the etching stopping layer and the projection removed.

A manufacturing method for an ink-jet head according to the present invention which comprises the steps of comprising the steps of providing a concave portion on a first main surface of a substrate, forming an etching stopping layer so as to become a hollow shape along a inside surface of a concave portion in the concave portion on the first main surface including the concave portion, exposing protrusively the etching stopping layer at the inside of the concave portion with the substrate from a second main surface etched, forming an electrode layer so as to bury a inside of the concave portion on the etching stopping layer of the first main surface side, and forming a protruded-type electrode by exposing the electrode layer with at least the etching stopping layer on the inside of the concave portion removed. Here, a manufacturing method for an ink-jet head according to the present invention further comprises the step of forming a core material layer at the first main surface side of the electrode layer, after forming the electrode layer.

In the manufacturing method of the ink-jet head according to the present invention, the etching stopping layer and the string shaped projection both of which are formed along the exact shape of the concave portion and the inside of the concave portion (or the opening of ink holder) formed by employing photolithography and anisotropic etching and so forth, are used as the basic patterns. Since the head is formed in such a way that the etching stopping layer and the string shaped projection are filled up by the electrode layer, the shape of the protruded-type electrode including the concave groove is formed with high accurate uniformity and formed minutely. When the etching stopping layer is the insulating layer formed by the thermal oxidization method, since the first pointed end of the concave portion is sharpened due to the growth toward the inside of the first concave portion of the thermal oxidized insulating layer formed on the inside of the first concave portion, the shape of the pointed end portion can be formed sharply and uniformly. According to the ink-jet head prepared by the above described method, the ink emitting performance and reliability thereof are greatly improved.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

A preferred embodiment of the invention will now be described in detail referring to the accompanying drawings.

Figure 1:
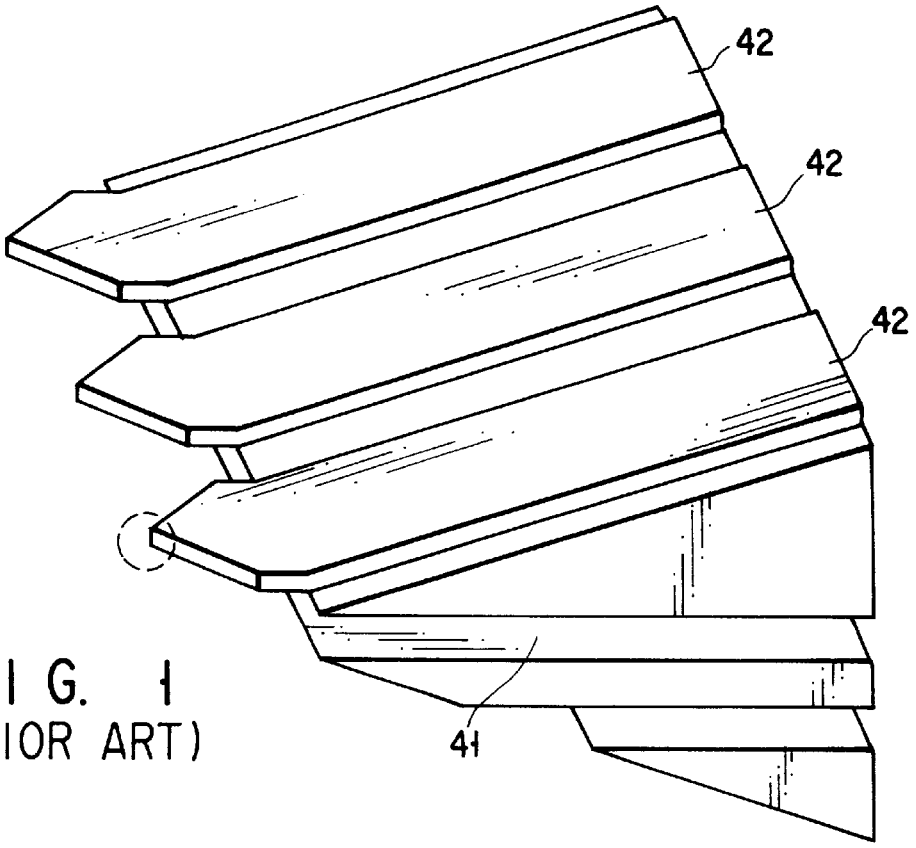
FIG. 1 (PRIOR ART)
FIG. 1 is a perspective view showing a construction of an ink-jet head according to the first conventional example.
Figure 2:
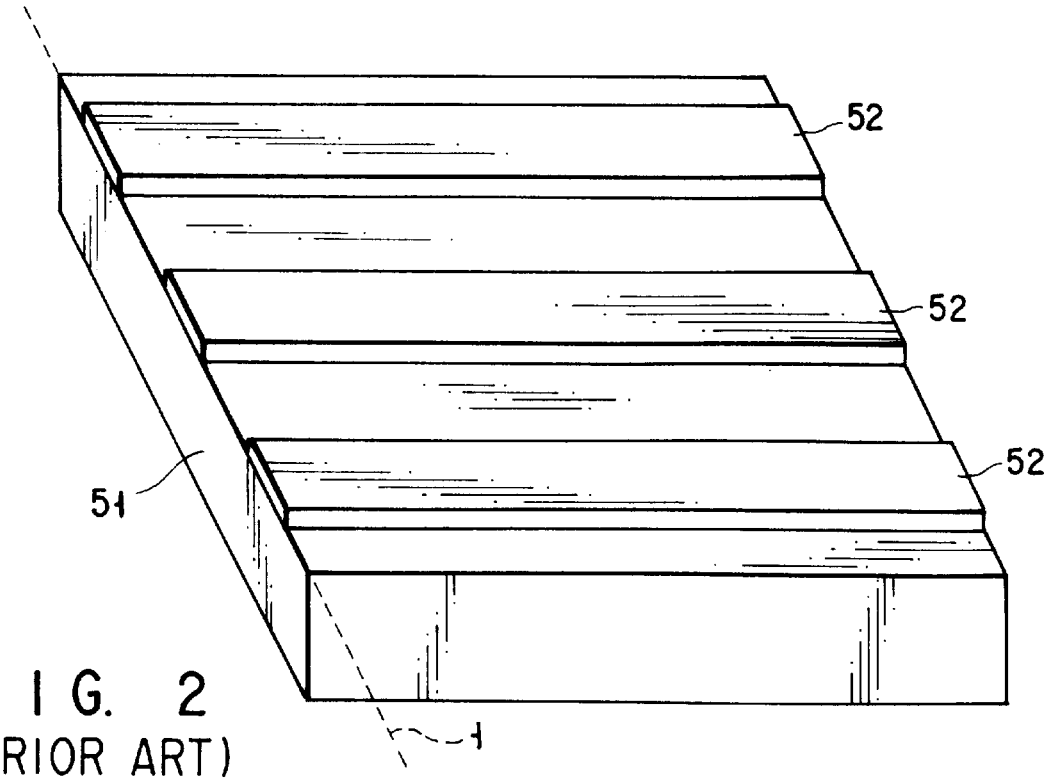
FIG. 2 (PRIOR ART)
FIG. 2 is a perspective view showing a construction of an ink-jet head according to the second conventional example.
Figure 3:
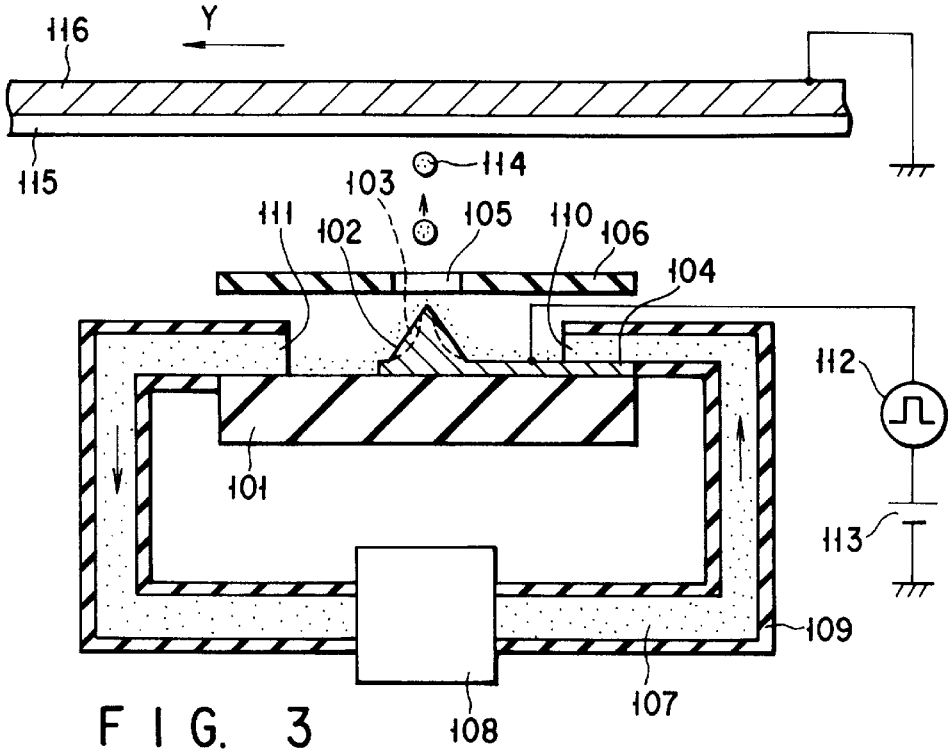
FIG. 3 is a schematic construction view of an ink-jet recording device according to a first embodiment of the present invention.

FIG. 3 is a schematic construction view of an ink-jet recording device according to a first embodiment of the present invention. In FIG. 3, a supporting substrate 101 is an electrically insulative substrate, such as a glass substrate. A protruded-type electrode 102 and its leading electrode 104 are formed on the supporting substrate 101. The protruded-type electrode 102 may include one of electrodes having various shapes which include a pyramid, e.g., a triangular pyramid, a rectangular pyramid, a polygonal pyramid or the like, and a circular cone, a circular cylinder, a hemisphere, and a Mexican pyramid. An ink guide groove 103 which is formed from the bottom portion to the pointed end portion on the wall surface, is provided at the protruded-type electrode 102. A connected portion by the protruded-type electrode 102 of the leading electrode 104 and an end portion of an opposite portion are exposed outward. An upper cover 106 having an ink-drop spewing outlet 105 which is corresponding to the protruded-type electrode 102 at the upper portion of the supporting substrate 101.

Figure 4:
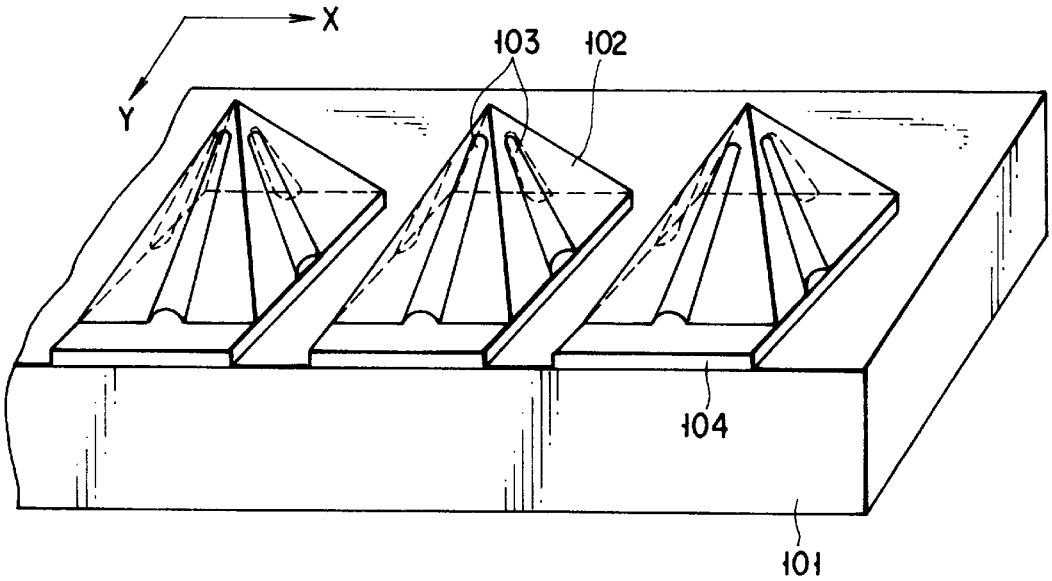
FIG. 4 is a perspective view showing a construction of a principal portion for an ink-jet head according to the first embodiment of the present invention.

FIG. 4 shows an enlarged part of FIG. 3 in which a multi-head such as a line-head is constituted. A plurality of protruded-type electrodes 102 are provided on the supporting substrate 101 along main scanning direction X. Further, in FIG. 4, the shape of the protruded-type electrode 102 is pyramid, and its pointed end portion is sharpened. Ink guide grooves 103 are formed on each wall surface of the pyramid of the protruded-type electrode 102. In this embodiment, a width of the ink guide groove 103 becomes narrower as the distance to the pointed end section decrease from the bottom section.

The ink 107 in which the plus-electrically charged color with the charge-controlled material and the binder are dissipated into dielectric solvent under the condition of more than $10^8$ Ωcm in colloidal state, is used in the entire embodiments including this one. The color is positively charged. The ink 107 is supplied on the supporting substrate 101 from the ink supplying opening 110 through the ink path 109 by the reflux mechanism 108 with the ink tank and the pump.

The ink 107 supplied on the supporting substrate 101 flows along the sub-scanning direction Y (relative movement direction of the record medium) on the surface of the supporting substrate 101. A part of the ink 107 arrives at the protruded-type electrode 102. The ink 107 arrived at the protruded-type electrode 102 ascends along the ink guide groove 103 formed on the wall surface of the protruded-type electrode 102 by the capillary phenomenon, before the ink 107 arrives at the pointed end of the protruded-type electrode 102 being the jetting point of the ink-drop. The remaining ink which can not arrive at the protruded-type electrode 102 of the supplied ink 107 supplying on the head substrate 120 is retrieved by the reflux mechanism 108 through the ink path 109 from the ink outlet opening 111.

The ink-jet head comprises the supporting substrate 101, the protruded-type electrode 102 with the ink guide groove 103, the leading electrode 104, the upper cover 106 with the ink-drop spewing outlet 105, the ink reflux mechanism 108, and the ink path 109 having the ink delivery opening 110 and the ink outlet opening 111.

A driving circuit 112 and a direct-current bias power source 113 are connected in series to the leading electrode 104. The driving circuit 112 produces for example a positive signal pulse voltage of 200V switched on or off depending on the image signal to be recorded. The positive signal pulse voltage is applied to the bias voltage of DC 1 kV with this voltage placed one upon another, which is supplied from the direct current bias power source 113, before this voltage is applied to the protruded-type electrode 102 through the leading electrode 104.

Namely, the voltage of the same polarity as the charged polarity of the color within the ink 107 is applied to the protruded-type electrode 102. Consequently, the condensed color components within the ink 107 arrived at the pointed end of the protruded-type electrode 102 are jetted as the ink-drop 114 in the approximately perpendicular to the surface of the supporting substrate 101 by the electrostatic repulsive force. The jetted ink-drop 114 passes through the ink-drop spewing outlet 105 provided with the upper cover 106. The recording paper 115 as the record medium is arranged oppositely to the supporting substrate 101 through the upper cover 106. The jetted ink-drops 114 are so arrived on the recording paper 115 that they jet because the jetted ink-drops are pulled by the opposite electrode 116 with the grounded voltage provided at the rear surface of the recording paper 115. For this reason, the image is recorded on the recording paper 115.

Next, the manufacturing method of the ink-jet head according to the embodiment will be explained.

FIGS. 5A to 5G are cross sectional views showing the manufacturing process of the ink-jet head, particularly, show a forming process of the one protruded-type electrode 102. Further, in the case of the multi-head, FIGS. 5A to 5G show the section of the sub-scanning direction Y, which is perpendicular to the main scanning direction of FIG. 4.

Figure 5A:
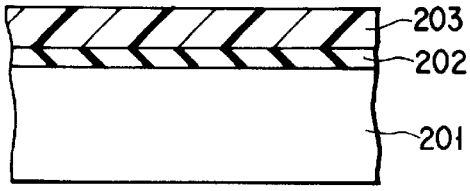
FIGS. 5A to 5G are process cross sectional views explaining manufacturing method of the ink-jet head according to the first embodiment of the present invention.
Figure 5B:
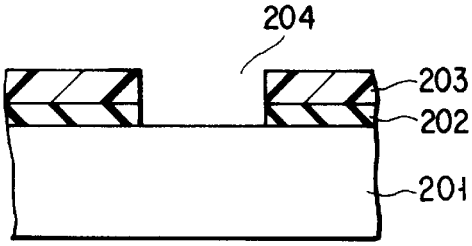
Figure 5C:
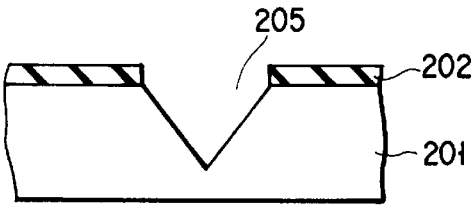

Firstly, the counter pyramidal shaped concave portion corresponding to the shape of the protruded-type electrode 102 is formed at the first main surface side portion of the Si single crystal substrate 201. The anisotropic etching of the Si single crystal substrate can be utilized as the forming method of such the concave portion. Namely, as shown in FIG. 5A, the $SiO_2$ thermal oxidized layer 202; thickness is 0.1 μm is formed on the Si single crystal substrate 201 of p-type (100) crystal plane orientation by using the dry oxidization method, before the resist 203 is applied by the spin-coat method thereon. Next, as shown in FIG. 5B, after patterning by exposure, development or the like so as to obtain a square-shaped opening 204 with a radius of 10 μm by using the stepper, the $SiO_2$ thermal oxidized layer 202 is etched by the $NH_4F$-HF mixed solution. Further, after removing the remaining resist, the anisotropic etching is implemented by using 30 wt %-KOH water solution. As shown in FIG. 5C, the counter pyramidal concave portion 205 with depth of 7.1 μm is formed on the Si single crystal substrate 201.

Figure 5D:
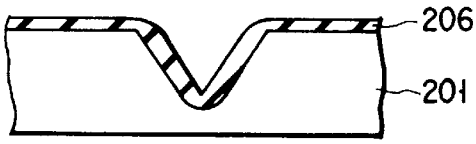

Next, once the $SiO_2$ oxidized layer 202 is removed by using $NH_4F$-HF mixed solution. As shown in FIG. 5D, the $SiO_2$ thermal oxidization insulative layer is formed as an etching stopping layer 206, which is hollow shape along the inner surface of the concave portion 205 on the Si single crystal substrate 201 with the inside of the concave portion 205. In this embodiment, the etching stopping layer 206 made of the $SiO_2$ thermal oxidization insulative layer is formed by the Wet oxidization method so as to become about 0.3 $\mu$m of thickness. In this case, a center section in the depth direction of the concave portion 205 of the etching layer 206 expands. Thereby the pointed end portion of the protruded-type electrode 102 which is a head tip formed in accordance with the method describing hereinafter can be sharpened. This would result in high electric field concentration effect with regard to the pointed end of the protruded-type electrode 102. Execution of high resolution as well as low voltage driving can be facilitated.

Figure 5E:
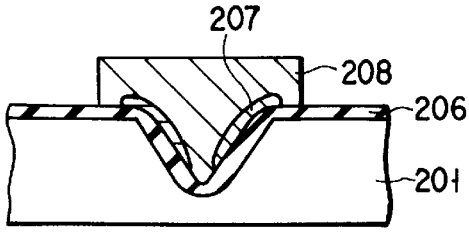

Next, as shown in FIG. 5E, it is formed string shaped projections 207 on the inside face of concave portion 205 by the gas-phase accumulation method using glass. Subsequently, it is formed a molybdenum layer, a tantalum layer, or a chromium layer as an electrode layer 208 which becomes the protruded-type electrode 102 and the leading electrode 104, on the etching stopping layer 206 made of $SiO_2$ thermal oxidization insulative layer and the string shaped projection 207 with the concave portion 205 buried. In this embodiment, it has been formed the molybdenum layer with thickness of 5 $\mu$m as the electrode layer 208 by the sputtering method. On the occasion, the sputtering is implemented by using mask so that the electrode layer 208 is formed selectively on the position where becomes an individual electrode 102 and the leading electrode 104 in the sub-scanning direction. Due to the circumstances of the material or the conductivity of the electrode layer 208, it is good for forming a conductive layer such as an ITO layer taking adhesion property into account while laminating.

When increasing the shape of the protruded-type electrode 102 is required, namely when the size or depth of the opening of the concave portion 205 becomes greater, it might be difficult in burying completely the inside of the concave portion 205 with the electrode layer 205 sufficiently thick formed. In such the case, it can be buried the inside of the concave portion 205 with a core material layer consisting of single or a plurality of materials from the first main surface side of the Si single crystal substrate 201 on the electrode 208 formed.

Figure 5F:
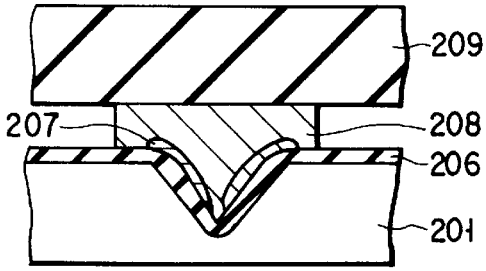

Next, as shown in FIG. 5F, the Pyrex glass substrate 209 through the Si single crystal substrate 201 and the electrode 208 are bonded across between the electrode layers 208 by using the electrostatic bonding method. It should be selected either the Pyrex glass substrate 209 is made directly the supporting substrate 101 or the Pyrex glass substrate 209 bonded with a relatively thick glass substrate is made the supporting substrate 101.

Figure 5G:
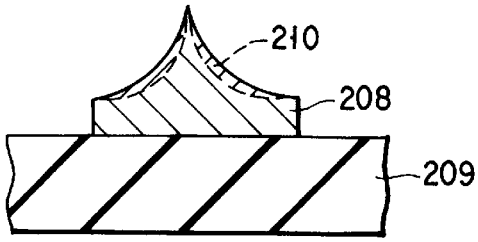

When the thickness of the electrode layer 208 is sufficiently thick, and has enough strength as the structural material, omitting the process shown in FIG. 5G, it is possible to bond directly the electrode layer 208 with the supporting substrate 101.

Next, as shown in FIG. 5G, the Si single crystal substrate 201 is etching-removed by a mixed solution including ethylenediamine, pyrocatechol, and pyrazine, then the thermal oxidized layer and the string shaped projected glass are removed by using a mixed acid of $NH_4F$-HF or the like or HF solution. As shown in FIG. 5G, the concave shaped groove 210 is formed on the electrode layer 208, with the result that the pyramidal protruded-type electrode 102 with the ink guide groove 103 shown in FIGS. 3 and 4.

Thus, in the ink-jet head according to the embodiment, it is formed an etching layer 206 made of $SiO_2$ thermal oxidization insulative layer on the Si single crystal substrate with the concave portion 205 formed by the anisotropic etching, before it formed the protruded-type electrode 102 by filling the electrode layer 208 on the inside of the concave portion 205. Consequently, the protruded-type electrode 102 corresponding to the shape of the concave portion 205 with superior uniformity and reliability can be formed.

Further, it also can be made the bottom shape of the concave portion 205 fine sharpened counter pyramidal shape, due to the shape repeatability of the concave portion 205 by the anisotropic etching and the propagation operation of the $SiO_2$ thermal oxidization insulative layer which becomes the etching stopping layer 206 to the inside of the concave portion 205. Thereby, it can stably formed the protruded-type electrode 102 with greatly enhanced the electric field focusing effect toward the pointed end thereof. As the result, it is not necessary to apply high voltage to the protruded-type electrode 102 to be the head tip. The implementation of the low voltage driving as well as making it possible to prevent the extraordinary discharge caused by the shape non-uniformity can be achieved. A simplification of the process can be planned since the thermal oxidization method is superior in the process matching property in respect of the general semiconductor manufacturing process.

It is necessary to be stably formed an ink layer at the pointed end portion of the protruded-type electrode 102 to be the head tip by the capillary phenomenon in order to jet with the ink-drop concentrated. Since it is formed the concave shaped ink guide groove 103 at the wall surface of the protruded-type electrode 102, the ink on the head substrate 102 ascends toward the pointed end of the protruded-type electrode 102. Since it can be stably formed the ink layer at the pointed end, an ink-injecting performance and reliability can be greatly improved.

Figure 6:
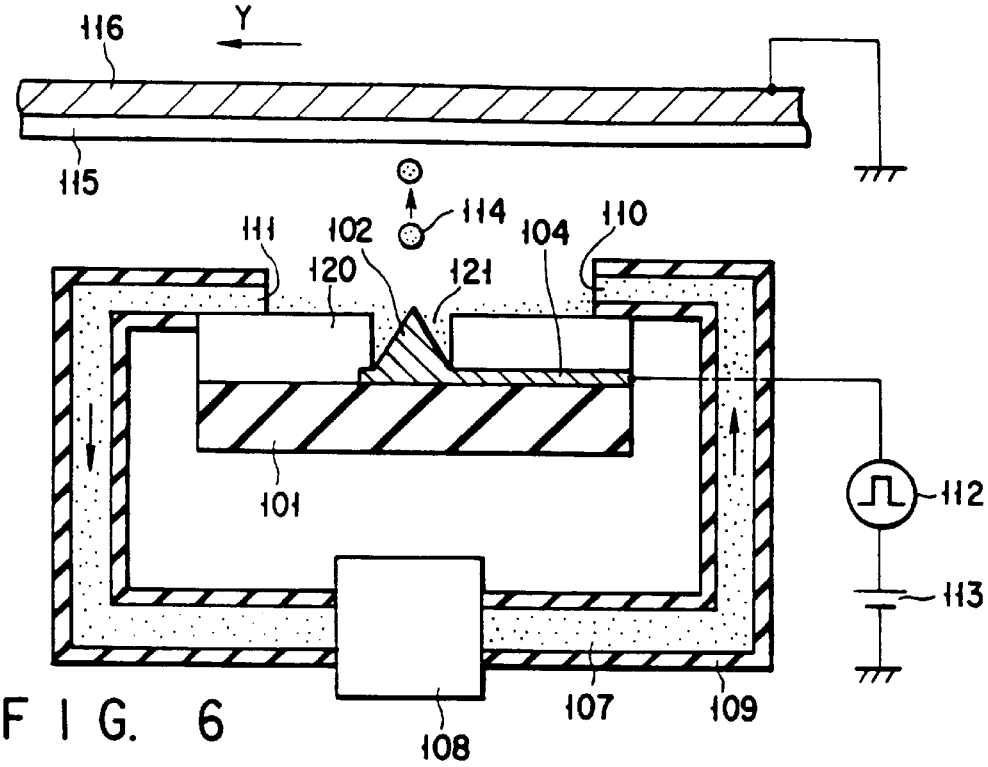
FIG. 6 is a shematic construction view of an ink-jet recording device according to a second embodiment of the present invention.

FIG. 6 is a schematic construction view of an ink-jet recording device according to a second embodiment of the present invention. In FIG. 6, the same portion of FIG. 3 is appended the same sign, and the detailed explanation is omitted.

The second embodiment is different from the first embodiment in that the second embodiment provides a concave shaped ink holder at the supporting substrate and the head substrate, and provides the protruded-type electrode within the ink holder.

It is formed the protruded-type electrode 102, the leading electrode 104 thereof, and the head substrate 120 on the supporting substrate 101. It is formed a rectangular shaped ink holder 121 which is hollowed from the surface thereof. The protruded-type electrode 102 is provided on the bottom surface of the ink holder 121. It is exposed outward a connected portion to the protruded-type electrode 102 of the leading electrode 104 and an opposite side end portion.

Figure 7:
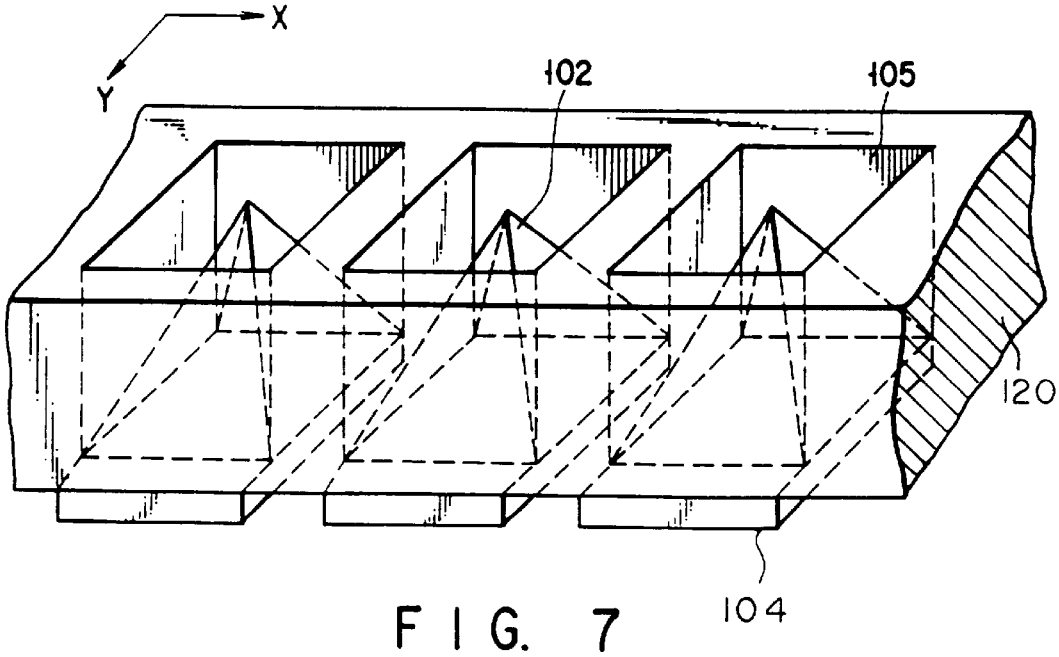
FIG. 7 is a perspective view showing a construction of a principal portion for an ink-jet head according to the second embodiment of the present invention.

FIG. 7 is a view showing enlarged portion of FIG. 6 when a multi-head such as the line-head is constituted. It is arranged a plurality of ink holders along the main scanning direction X on the head substrate 120. Each of the protruded-type electrode 102 is provided on the inside of the respective ink holders 105. Also, as shown in FIG. 7, in this embodiment the shape of the protruded-type electrode 102 is pyramidal, and its tip is sharpened. The position of the pointed end portion of the protruded-type electrode 102 can be the same face as the position of the opening end edge of the ink holder 121, and can be the projected state or being given hollows. Further, as described hereinafter, after the ink entering into the ink holder 121, the pointed of the protruded-type electrode 102 can be projected from the surface of the ink within the ink holder 121, and can also be submerged beneath the surface of the ink.

The ink 107 for used in the second embodiment is the same one as the first embodiment. The ink 107 is supplied on the head substrate 120 from the ink supplying opening 110 through the ink path 109 by the reflux mechanism 108 with the ink tank and the pump.

The ink 107 supplied on the head substrate 120 flows along the sub-scanning direction Y (relative movement direction of the record medium) on the surface of the head substrate 120. A part of the ink 107 arrives at the ink holder 121 entering into the inside of the ink holder 121. The ink 107 entered into the inside of the ink holder 121 ascends along the wall surface of the protruded-type electrode 102 due to the capillary phenomenon, before the ink 107 arrives at the pointed end of the protruded-type electrode 102 to be the jetting point of the ink-drop. The remaining ink which can not enter into the ink holder 121 and overflows therefrom is retrieved by the reflux mechanism 108 through the ink path 109 from the ink outlet opening 111.

The ink-jet head comprises the supporting substrate 101, the protruded-type electrode 102, the leading electrode 104, the head substrate 120 with the ink holder 121, the ink reflux mechanism 108, and the ink path 109 having the ink delivery opening 110 and the ink outlet opening 111.

A driving circuit 112 and a direct-current bias power source 113 are connected in series to the leading electrode 104 in the same way as the above first embodiment. The voltage which is the same polarity as the charged polarity of the color component within the ink 107 is applied to the leading electrode 104. Consequently, the condensed color components within the ink 107 arrived at the pointed end of the protruded-type electrode 102 are jetted as the ink-drop 114 in the approximately perpendicular to the surface of the supporting substrate 101 by the electrostatic repulsive force. The jetted ink-drops 114 are so arrived on the recording paper that they jet because the jetted ink-drops are pulled by the opposite electrode 116 with the grounded voltage provided at the rear surface of the recording paper 115. For this reason, the image is recorded on the recording paper 115.

Next, the manufacturing method of the ink-jet head according to the second embodiment of the present invention will be explained.

FIGS. 8A to 8H are cross sectional views showing the manufacturing process of the ink-jet head, particularly, show a forming process of the one protruded-type electrode 102 and the ink holder 121. Further, in the case of the multi-head, FIGS. 8A to 8H show the section of the sub-scanning direction Y, which is perpendicular to the main scanning direction of FIG. 7.

Figure 8A:
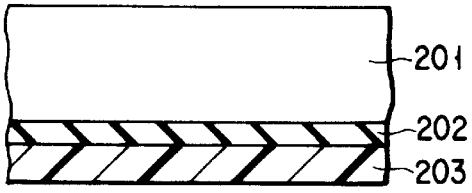
FIGS. 8A to 8H are process cross sectional views explaining manufacturing method of the ink-jet head according to the second embodiment of the present invention.
Figure 8B:
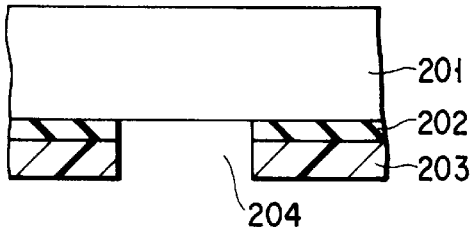
Figure 8C:
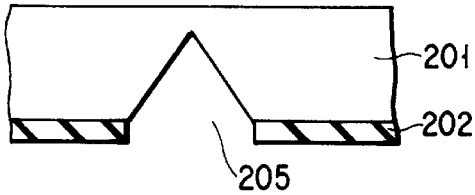

Firstly, the counter pyramidal shaped concave portion corresponding to the shape of the protruded-type electrode 102 is formed at the first main surface side portion of the Si single crystal substrate 201. The anisotropic etching of the Si single crystal substrate can be utilized as the forming method of such the concave portion. Namely, as shown in FIG. 8A, the $SiO_2$ thermal oxidized layer 202; thickness is 0.1 $\mu$m is formed on the Si single crystal substrate 201 of p-type (100) crystal plane orientation by using the dry oxidization method, before the resist 203 is applied by the spin-coat method thereon. Next, as shown in FIG. 8B, after patterning by exposure, development or the like so as to obtain a square-shaped opening 204 with a radius of 10 $\mu$m by using the stepper, the $SiO_2$ thermal oxidized layer 202 is etched by the $NH_4F$-HF mixed solution. Further, after removing the remaining resist, the anisotropic etching is implemented by using 30 wt %-KOH water solution. As shown in FIG. 8C, the counter pyramidal concave portion 205 with depth of 7.1 $\mu$m is formed on the Si single crystal substrate 201.

Figure 8D:
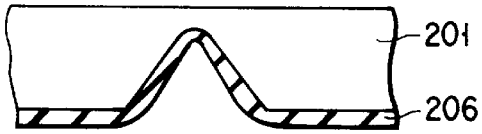

Next, once the $SiO_2$ oxidized layer 202 is removed by using $NH_4F$-HF mixed solution. As shown in FIG. 8D, the $SiO_2$ thermal oxidization insulative layer is formed as an etching stopping layer 206, which is hollow shape along the inner surface of the concave portion 205 on the Si single crystal substrate 201 with the inside of the concave portion 205. In this embodiment, the etching stopping layer 206 made of the $SiO_2$ thermal oxidization insulative layer is formed by the Wet-oxidization method so as to become about 0.3 $\mu$m of thickness. In this case, a center section in the depth direction of the concave portion 205 of the etching layer 206 expands as shown in FIG. 8D. Thereby the pointed end portion of the protruded-type electrode 102 which is a head tip formed in accordance with the method describing after can be sharpened. This would result in high electric field concentration effect with regard to the pointed end of the protruded-type electrode 102. Implementation of high resolution as well as low voltage driving can be facilitated.

Figure 8E:
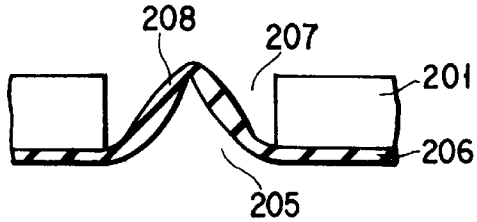

Subsequently, the resist is applied on the surface of the opposite side portion to the first concave portion 205, namely to the second main surface side portion of the Si single crystal substrate 201. The patterning is so executed that there is provided an opening at the position corresponding to the first concave portion 205, before etching the Si single crystal substrate 201 by Reactive Ion Etching (RIE), the second concave portion 207 which becomes the ink holder 121 is formed thereon as shown in FIG. 8E. Subsequently, the etching stopping layer 206 on the bottom portion of the inside of the first concave portion 205 is exposed as the pyramidal shaped projection 208.

Figure 8F:
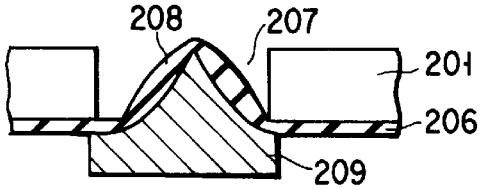

Next, after removing the resist, as shown in FIG. 8F, it is formed a molybdenum layer, a tantalum layer, or a chromium layer as an electrode layer 209 which becomes the protruded-type electrode 102 and the leading electrode 104, on the etching stopping layer 206 made of $SiO_2$ thermal oxidization insulating layer and the string shaped projection 207 with the concave portion 205 buried. In this embodiment, it has been formed the molybdenum layer with thickness of 5 $\mu$m as the electrode layer 208 by the sputtering method. On the occasion, the sputtering is implemented by using mask so that the electrode layer 209 is formed selectively on the position where becomes approximately ink holder 121 which is slightly larger than the size of the second concave portion 207 or where does not affect the adjacent electrode in the sub-scanning direction. Due to the circumstances of the material or the conductivity of the electrode layer 209, it is good for forming a conductive layer such as an ITO layer taking adhesion property into account while laminating.

Figure 8G:
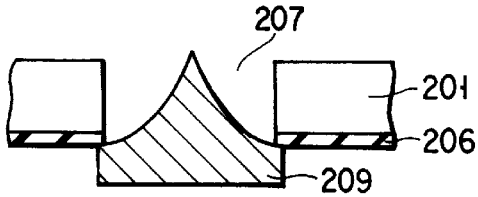

Next, the portion on the inside surface of the second concave portion 207 is removed selectively in the etching stopping layer 206 made of the $SiO_2$ thermal oxidized layer by using the $NH_4F$-HF mixed solution. As the result, the pyramidal shaped protruded-type electrode 102 as shown in FIGS. 6 and 7 is formed by exposing the electrode 209 to the inside of the second concave portion 207 which becomes the opening of the ink holder 121 as shown in FIG. 8G.

Figure 8H:
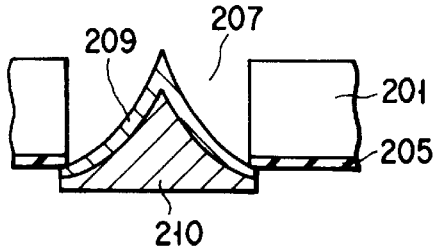

When increasing the shape of the protruded-type electrode 102 is required, namely when the size or depth of the opening of the first concave portion 205 becomes greater, it might be difficult in burying completely the inside of the first concave portion 205 with the electrode layer 209 sufficiently thick formed. In such the case, as shown in FIG. 8H, it can be buried the inside of the first concave portion 205 with a core material layer 210 consisting of single or a plurality of materials from the first main surface side of the Si single crystal substrate 201 on the electrode 209 formed.

Thus, according to the manufacturing method of the ink-jet head for the second embodiment, it is formed an etching stopping layer 206 made of $SiO_2$ thermal oxidization insulative layer on the Si single crystal substrate 101 with the first concave portion 205 formed by the anisotropic etching, before it formed the protruded-type electrode 102 by filling the electrode layer 209 on the inside of the first concave portion 205. Further it is formed the ink holder 121 with the part of the concave portion 205 of the etching stopping 206 selectively removed. Consequently, similar to the first embodiment, the protruded-type electrode 102 corresponding to the shape of the concave portion 205 with superior uniformity and reliability can be formed.

Further, due to the same reason as the first embodiment, the implementation of the low voltage driving as well as making it possible to prevent the extraordinary discharge caused by the shape non-uniformity can be achieved. A simplification of the process can be planned since the thermal oxidization method is superior in the process matching property in respect of the general semiconductor manufacturing process.

As stated above, the ink-jet recording device according to the present invention, it can be provided the protruded-type electrode 102 which is the opposite head tip to the recording paper 115 in the ink-jet head, on the main surface of the head substrate 120 instead of the end face. Consequently, a very few damages of the protruded-type electrode 102 caused by the contact with the recording paper 115 in the printer assembly may occur.

In the above embodiment, the bottom portion of the protruded-type electrode might be 0.5 to 200 $\mu$m, and 5 to 80 $\mu$m is more preferable. A small radius of curvature of the pointed end portion is preferable. 0.5 to 100 $\mu$m is preferable, and 5 to 20 $\mu$m is more preferable.

In the first embodiment, since it is formed the concave shaped ink guide groove 103 at the wall surface of the protruded-type electrode 102, the ink on the head substrate 102 ascends toward the pointed end of the protruded-type electrode 102 by the capillary phenomenon. Since it can be stably and easily formed the ink layer at the pointed end, high performance and high quality of the ink-jet recording device can be realized.

In the second embodiment, since the protruded-type electrode 102 is provided on the inside of the ink holder 121, the ink layer including the stably concentrated color component is formed due to the capillary phenomenon or the like at the pointed end of the protruded-type electrode 102. Further, as shown in this embodiment, when the multi-head such as the line-head having a plurality of the protruded-type electrodes 102 is formed, the electric field interference between the adjacent protruded-type electrodes 102 is prevented by the wall of the ink holder 121. Concentration and the jet from the individual protruded-type electrodes 102 are stabilized. There are no problems that the ink-drops repulsed between the electrodes jet between the electrodes. High performance and high quality of the ink-jet recording device can be realized.

In these embodiments, it might be covered a part or whole surface of the protruded-type electrode 102 in order to supply the electric field enough to concentrate and to jet in regard to the ink 107. The color within the ink 107 might be charged with negative polarity. In this case, it might be applied minus voltage to the protruded-type electrode 102 through the leading electrode 104.

Figure 9A:
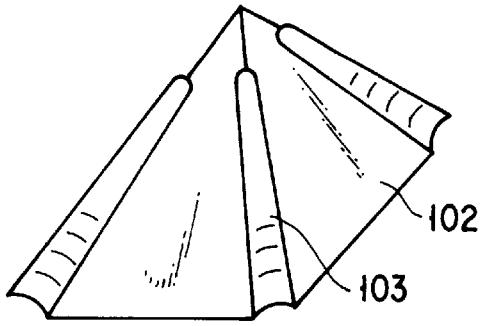
FIGS 9A to 9C are views showing constructions of projection-shaped electrodes in an ink-jet head according to the present invention.
Figure 9B:
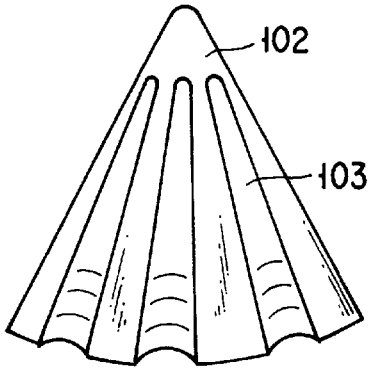
Figure 9C:
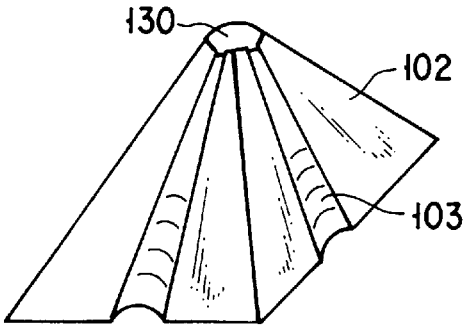

In the above described first embodiment, the ink guide groove 103 is provided on the broad wall surface of the protruded-type electrode 102 with pyramidal shape. As shown in FIG. 9A, it might be formed the ink guide groove 103 at the position where a ridge line of the pyramid is formed. It is not necessary that the shape of the protruded-type electrode 102 is of the pyramid. As shown in FIG. 9B, it might be formed the corn-shaped protruded-type electrode 102, and formed the ink guide groove 103 at the corn-shaped wall surface. If the construction can be supplied easily and stably the ink to the pointed end portion of the protruded-type electrode, as shown in the second embodiment, it might not be provided the ink guide groove. Further, as shown in FIG. 9C, in order to fill about fixed volume of quantity of ink supplied to the pointed end portion, it might be provided the concave portion 130 at the pointed end portion of the protruded-type electrode as the ink holder. This construction of the protruded-type electrode is applicable to the second embodiment.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An ink-jet head for use in an ink-jet recording device which records on a record medium with an ink, comprising:

a substrate having a main surface, said main surface being provided oppositely to the record medium;

a protruded-type nozzle-less electrode provided on said main surface of said substrate; and an ink supplying means for supplying the ink on said main surface to at least a vicinity of said protruded-type electrode of said substrate, wherein said protruded-type electrode is made by a molding method.

2. An ink-jet head according to claim 1, wherein said protruded-type electrode comprises a bottom portion contacting with said substrate, a pointed end portion, and a groove formed from said bottom portion toward said pointed end portion.

3. An ink-jet head according to claim 2, wherein said protruded-type electrode further includes a concave portion formed at said pointed end portion.

4. An ink-jet head according to claim 1, wherein said substrate has at least one concave portion within which said protruded-type electrode is provided, and said ink supplying means supplies said ink into said concave portion.

5. An ink-jet head according to claim 4, wherein said protruded-type electrode comprises a bottom portion contacting with said substrate, a pointed end portion, and a groove formed from said bottom portion toward said pointed end portion.

6. An ink-jet head according to claim 5, wherein said protruded-type electrode further includes a concave portion formed at said pointed end portion.

7. An ink-jet head according to claim 1, wherein:

said electrode is provided on a main exterior surface of said substrate;

said electrode is solid; and said ink supplying means supplies ink to an exterior surface of said solid electrode.

8. An ink-jet head according to claim 7, wherein:

said electrode has a plurality of exterior surface grooves;

said ink supplying means supplies ink to said exterior surface grooves of said electrode.

9. An ink-jet recording device which records on a record medium with an ink, comprising:

an ink-jet head including, a substrate having a main surface, said main surface being provided oppositely to the record medium, a protruded-type nozzle-less electrode provided on said main surface of said substrate, and an ink supplying means for supplying the ink on said main surface to at least a vicinity of said protruded-type electrode of said substrate, the ink having a color component, wherein said protruded-type electrode is made by a molding method; and a voltage applying means for applying a voltage to said protruded-type electrode in which said voltage corresponds to an image signal to jet at least the color component in the ink supplied on said substrate by said ink supplying means from said protruded-type electrode toward the record medium.

10. An ink-jet recording device according to claim 9, wherein said protruded-type electrode comprises a bottom portion contacting with said substrate, a pointed end portion, and a groove formed from said bottom portion toward said pointed end portion.

11. An ink-jet recording device according to claim 10, wherein said protruded-type electrode further includes a concave portion formed at said pointed end portion.

12. An ink-jet recording device according to claim 9, wherein said substrate has at least one concave portion within which said protruded-type electrode is provided, and said ink supplying means supplies said ink into said concave portion.

13. An ink-jet recording device according to claim 12, wherein said protruded-type electrode comprises a bottom portion contacting with said substrate, a pointed end portion, and a groove formed from said bottom portion toward said pointed end portion.

14. An ink-jet recording device according to claim 13, wherein said protruded-type electrode further includes a concave portion formed at said pointed end portion.

15. An ink-jet recording device which records on a record medium with an ink, comprising:

an ink-jet head including, a substrate having a main surface, said main surface being provided oppositely to the record medium, a protruded-type nozzle-less electrode provided on said main surface of said substrate, and an ink supplying means for supplying the ink on said main surface to at least a vicinity of said protruded-type electrode of said substrate, the ink having a color component which has a charged polarity, wherein said protruded-type electrode is made by a molding method; and a voltage applying means for applying a voltage to said protruded-type electrode in which said voltage corresponds to an image signal which has a polarity the same as the charged polarity of the color component, to jet at least the color component in the ink supplied on said substrate by said ink supplying means from said protruded-type electrode toward the record medium.

16. An ink-jet recording device according to claim 15, wherein said protruded-type electrode comprises a bottom portion contacting with said substrate, a pointed end portion, and a groove formed from said bottom portion toward said pointed end portion.

17. An ink-jet recording device according to claim 16, wherein said protruded-type electrode further includes a concave portion formed at said pointed end portion.

18. An ink-jet recording device according to claim 15, wherein said substrate has at least one concave portion within which said protruded-type electrode is provided, and said ink supplying means supplies said ink into said concave portion.

19. An ink-jet recording device according to claim 18, wherein said protruded-type electrode comprises a bottom portion contacting with said substrate, a pointed end portion, and a groove formed from said bottom portion toward said pointed end portion.

20. An ink-jet recording device according to claim 17, wherein said protruded-type electrode further includes a concave portion formed at said pointed end portion.

21. An ink-jet head for use in an ink-jet recording device which records on a record medium with an ink, comprising:

a substrate having a main surface, said main surface being provided oppositely to the record medium;

a protruded-type nozzle-less electrode provided on said substrate, wherein said protruded-type electrode comprises a bottom portion contacting with said main surface of said substrate, a pointed end portion, and a groove formed from said bottom portion toward said pointed end portion; and an ink supplying means for supplying the ink on said main surface to at least a vicinity of said protruded-type electrode of said substrate.

22. An ink-jet head according to claim 21, wherein said protruded-type electrode further includes a concave portion formed at said pointed end portion.

23. An ink-jet head according to claim 21, wherein said substrate has at least one concave portion within which said protruded-type electrode is provided, and said ink supplying means supplies said ink into said concave portion.

24. An ink-jet recording device which records on a record medium with an ink, comprising:

an ink-jet head including, a substrate having a main surface, said main surface being provided oppositely to the record medium, a protruded-type nozzle-less electrode provided on said substrate, wherein said protruded-type electrode comprises a bottom portion contacting with said main surface of said substrate, a pointed end portion, and a groove formed from said bottom portion toward said pointed end portion, and an ink supplying means for supplying the ink on said main surface to at least a vicinity of said protruded-type electrode of said substrate, the ink having a color component; and a voltage applying means for applying a voltage to said protruded-type electrode in which said voltage corresponds to an image signal to jet at least the color component in the ink supplied on said substrate by said ink supplying means from said protruded-type electrode toward the record medium.

25. An ink-jet recording device according to claim 24, wherein said protruded-type electrode further includes a concave portion formed at said pointed end portion.

26. An ink-jet recording device according to claim 24, wherein said substrate has at least one concave portion within which said protruded-type electrode is provided, and said ink supplying means supplies said ink into said concave portion.

27. An ink-jet recording device which records on a record medium with an ink, comprising:

an ink-jet head including, a substrate having a main surface, said main surface being provided oppositely to the record medium, a protruded-type nozzle-less electrode provided on said substrate, wherein said protruded-type electrode comprises a bottom portion contacting with said main surface of said substrate, a pointed end portion, and a groove formed from said bottom portion toward said pointed end portion, and an ink supplying means for supplying the ink on said main surface to at least a vicinity of said protruded-type electrode of said substrate, the ink having a color component which has a charged polarity; and a voltage applying means for applying a voltage to said protruded-type electrode in which said voltage corresponds to an image signal which has a polarity the same as the charged polarity of the color component, to jet at least the color component in the ink supplied on said substrate by said ink supplying means from said protruded-type electrode toward the record medium.

28. An ink-jet recording device according to claim 27, wherein said protruded-type electrode further includes a concave portion formed at said pointed end portion.

29. An ink-jet recording device according to claim 27, wherein said substrate has at least one concave portion within which said protruded-type electrode is provided, and said ink supplying means supplies said ink into said concave portion.

30. An ink-jet head for use in an ink-jet recording device which records on a record medium with an ink, comprising:

a substrate having a main surface, said main surface being provided oppositely to the record medium;

a protruded-type nozzle-less electrode provided on said substrate; and an ink supplying means for supplying the ink on said main surface to at least a vicinity of said protruded-type electrode of said substrate, wherein said substrate has at least one concave portion within which said protruded-type electrode is provided, and said ink supplying means supplies said ink into said concave portion.

31. An ink-jet head according to claim 30, wherein said protruded-type electrode comprises a bottom portion contacting with said substrate, a pointed end portion, and a groove formed from said bottom portion toward said pointed end portion.

32. An ink-jet head according to claim 31, wherein said protruded-type electrode further includes a concave portion formed at said pointed end portion.

33. An ink-jet recording device which records on a record medium with an ink, comprising:

an ink-jet head including, a substrate having a main surface, said main surface being provided oppositely to the record medium, a protruded-type nozzle-less electrode provided on said substrate, and an ink supplying means for supplying the ink on said main surface to at least a vicinity of said protruded-type electrode of said substrate, the ink having a color component, wherein said substrate has at least one concave portion within which said protruded-type electrode is provided, and said ink supplying means supplies said ink into said concave portion; and a voltage applying means for applying a voltage to said protruded-type electrode in which said voltage corresponds to an image signal to jet at least the color component in the ink supplied on said substrate by said ink supplying means from said protruded-type electrode toward the record medium.

34. An ink-jet recording device according to claim 33, wherein said protruded-type electrode comprises a bottom portion contacting with said substrate, a pointed end portion, and a groove formed from said bottom portion toward said pointed end portion.

35. An ink-jet recording device according to claim 34, wherein said protruded-type electrode further includes a concave portion formed at said pointed end portion.

36. An ink-jet recording device which records on a record medium with an ink, comprising:

an ink-jet head including, a substrate having a main surface, said main surface being provided oppositely to the record medium, a protruded-type nozzle-less electrode provided on said substrate, and an ink supplying means for supplying the ink on said main surface to at least a vicinity of said protruded-type electrode of said substrate, the ink having a color component which has a charged polarity, wherein said substrate has at least one concave portion within which said protruded-type electrode is provided, and said ink supplying means supplies said ink into said concave portion; and a voltage applying means for applying a voltage to said protruded-type electrode in which said voltage corresponds to an image signal which has a polarity the same as the charged polarity of the color component, to jet at least the color component in the ink supplied on said substrate by said ink supplying means from said protruded-type electrode toward the record medium.

37. An ink-jet recording device according to claim 36, wherein said protruded-type electrode comprises a bottom portion contacting with said substrate, a pointed end portion, and a groove formed from said bottom portion toward said pointed end portion.

38. An ink-jet recording device according to claim 37, wherein said protruded-type electrode further includes a concave portion formed at said pointed end portion.

* * * * *